United States Patent [19]

Peterman

[11] Patent Number: 4,607,896

[45] Date of Patent: Aug. 26, 1986

[54] LOCK FOR MOBILE STORAGE APPARATUS

[75] Inventor: Robert J. Peterman, Hartland, Wis.

[73] Assignee: Spacesaver Corporation, Fort Atkinson, Wis.

[21] Appl. No.: 575,216

[22] Filed: Jan. 30, 1984

[51] Int. Cl.[4] ..... A47B 53/02

[52] U.S. Cl. ..... 312/201; 312/250

[58] Field of Search ..... 312/198, 201, 250; 248/429, 501, 178, 646, 669; 292/171, 141; 104/249, 250, 252; 188/5, 6, 82.3, 82.4, 38.5

[56] References Cited

U.S. PATENT DOCUMENTS

| | | | |
|---|---|---|---|
| 604,982 | 5/1898 | Habermaas | 292/141 |
| 872,247 | 11/1907 | Moss | 248/429 |
| 1,200,693 | 10/1916 | Barton et al. | 312/235 R |
| 2,572,730 | 10/1951 | Jones et al. | 292/171 |
| 4,017,131 | 4/1977 | Camenisch | 312/201 |
| 4,138,173 | 2/1979 | Taniwaki | 312/198 |
| 4,469,382 | 9/1984 | Slaats et al. | 312/201 |

FOREIGN PATENT DOCUMENTS

| | | | |
|---|---|---|---|
| 81538 | 11/1918 | Switzerland | 188/6 |

*Primary Examiner*—William E. Lyddane
*Assistant Examiner*—Joseph Falk
*Attorney, Agent, or Firm*—Fuller, House & Hohenfeldt

[57] ABSTRACT

A locking mechanism for a mobile storage system comprises a reciprocable lock bar selectively engageable with a rack fastened to a system track. The lock bar is moved into and out of engagement with the rack by a push-pull cable actuated by a conventional key and lock device. The lock bar is urged into engagement with the rack by a spring. Each rack tooth is formed with a vertical and a sloping surface, and the lock bar has cooperating surfaces. When the mobile storage unit is moved in one direction the lock bar ratchets over the teeth sloping surfaces against the spring bias, but movement is prevented in the opposite direction because the spring urges the lock bar vertical surface into cooperating engagement with a rack tooth vertical surface.

4 Claims, 4 Drawing Figures

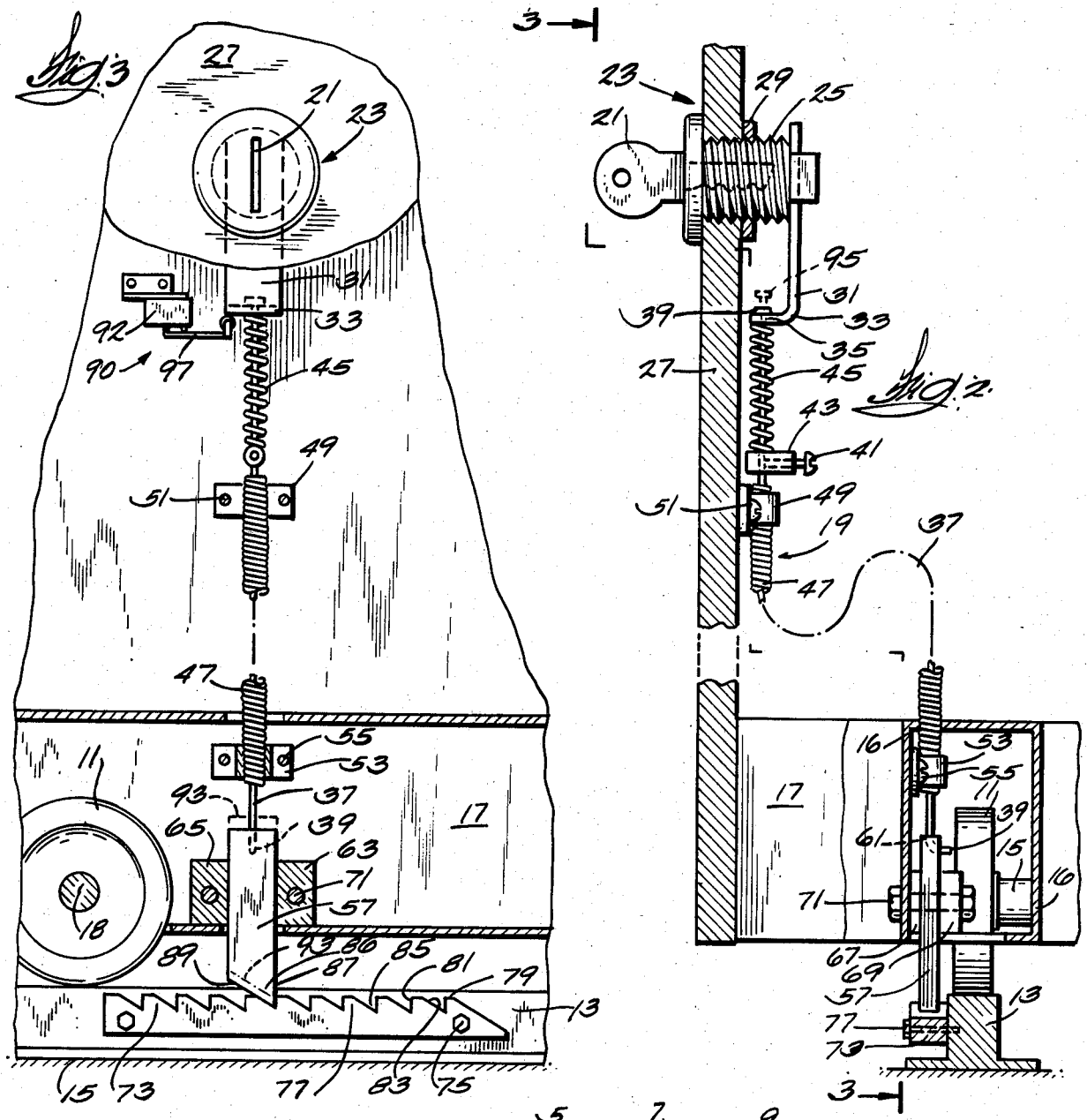
Fig. 3
Fig. 2
3
27
21
23
29
25
95
31
33
35
39
45
43
41
49
51
19
37
47
55
53
93
65
63
71
57
11
17
18
89
86
85
81
79
13
15
73
77
83
75
16
61
67
69
77
78
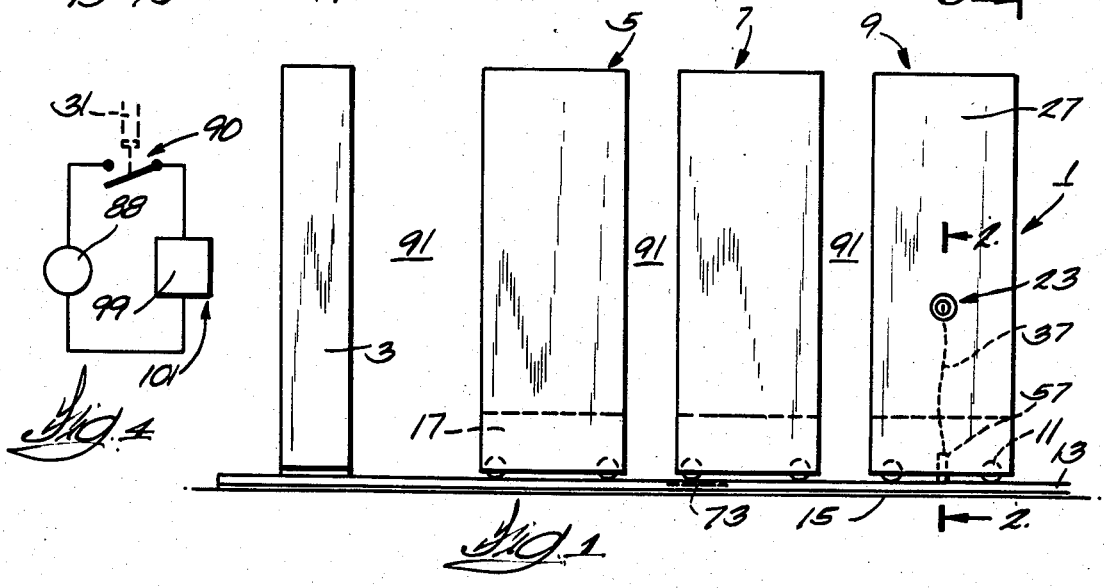
31
90
88
99
101
Fig. 4
5
7
9
27
1
2
91
3
23
37
57
11
13
17
73
15
Fig. 1

LOCK FOR MOBILE STORAGE APPARATUS

BACKGROUND OF THE INVENTION

1. Field of the Invention

This invention pertains to locking apparatus, and more particularly to apparatus for locking a mobile storage unit in a predetermined location.

2. Description of the Prior Art

It is well known to equip mobile filing and storage systems with locking mechanisms. For example, my co-pending U.S. patent application Ser. No. 514,114, filed July 15, 1983, discloses a locking mechanism used in conjunction with a handwheel which aids the movement of the storage unit along floor tracks. Although the locking mechanism disclosed in patent application Ser. No. 514,114 provides excellent operating qualities, it is limited to use with a handwheel operated system. It is thus not satisfactory for electrically driven storage units or for manually moved units that are not handwheel operated.

Another drawback of previous locking devices is that they must be set in the locked mode only when the storage unit is at the desired location along the tracks. Damage usually results if the lock is actuated and then the storage unit is moved. Further, prior locking mechanisms are designed such that they firmly lock the storage units against movement in two directions. It is not possible, for example, for a locked storage unit to be freely movable in one direction but to be prevented from moving in the opposite direction. The necessity of always unlocking the storage unit before moving it and then relocking it at the new location is inconvenient and undesirable, particularly if only small increments of motion are required.

Thus, a need exists for a mobile storage system locking apparatus which may be actuated to the locked mode prior to moving the storage unit to the desired locked location and which firmly locks the storage unit in place against unintended motion.

SUMMARY OF THE INVENTION

In accordance with the present invention, there is provided an inexpensive, reliable, and versatile locking mechanism for mobile storage apparatus that may be set in the locked mode prior to moving the storage unit along fixed tracks to the desired locked location. This is accomplished by apparatus that includes a spring loaded lock bar carried by the movable storage unit for selective engagement with a stationary rack attached to a floor track.

The lock bar is actuated by a key operated actuator, such as an electric solenoid. In the preferred embodiment, the actuator is a flexible push-pull cable that may be mounted at any convenient place on the storage unit. The cable induces reciprocation of the lock bar for engagement or disengagement with the rack. The rack teeth and lock bar are designed such that they always permit the storage unit to freely pass over the rack in one direction, but they firmly engage to prevent movement in the opposite direction. For that purpose, the lock bar is spring loaded into the locked mode. The spring urges the lock bar into engagement with the rack teeth, but it permits the lock bar to ratchet over the teeth without harm in one direction of storage unit movement. Further, the spring allows the locked mode to be selected and retained by the key even if the lock bar contacts a rack tooth tip upon locking actuation.

Positive means are utilized to position the lock bar to the unlocked position. The rack has several teeth, thus providing flexibility in the locked location of the storage unit. In electrically driven storage units, the locking mechanism includes an optional safety switch for disabling the electric motors.

Other objects and advantages and features of the invention will become apparent from the disclosure.

BRIEF DESCRIPTION OF THE DRAWINGS

FIG. 1 a side view of a typical mobile storage system showing the ends of mobile storage units employing the locking, mechanism of the present invention;

FIG. 2 is a cross-sectional view taken along lines 2—2 of FIG. 1;

FIG. 3 view taken along lines 3—3 of FIG. 2; and

FIG. 4 is a schematic representation of an electrical safety circuit used in conjunction with the present invention for controlling the movement of the storage units.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Referring to FIG. 1, reference numeral 1 illustrates an office or library mobile storage system that advantageously employs the locking mechanism of the present invention. The mobile storage system 1 typically includes a fixed storage unit 3, one or more intermediate mobile storage units 5 and 7, and a mobile end storage unit 9. To easily move the mobile storage units 5, 7, and 9, they are equipped with wheels 11 that ride along two or more parallel tracks 13 in a well known manner. The tracks are firmly imbedded in the floor 15 of the office or library. The wheels 11 are fixed to shafts 18, FIGS. 2 and 3, which are mounted for rotation in conventional bearings, not shown, in vertical walls 16 of storage unit carriage 17. The shaft 18 may be connected to a suitable electric motor for driving the storage unit along the tracks.

In accordance with the present invention, a locking mechanism 19 is provided on end storage unit 9 for locking the mobile storage units securely against movement at a desired location along the tracks 13. In the embodiment illustrated in FIGS. 2 and 3, the locking mechanism includes an actuator in the form of a key 21 which operates a conventional lock 23 having a barrel 25. The lock 23 may be mounted at any convenient place on the storage unit 9; a waist high placement on face panel 27 is preferred. To secure the lock 23 to the face panel 27, a nut 29 is threaded tightly onto the barrel 25.

Turning the key 21 in the lock 23 causes limited vertical reciprocation, as viewed in FIGS. 2 and 3, of an L-shaped latch 31 in a well known manner. The latch 31 is coupled by appropriate means to a lock bar 57 that engages a rack 73 firmly attached to a track 13 by screws 75. For example, the lock bar 57 may respond to the latch actuation through an electric solenoid mounted to the carriage 17 and having the lock bar 57 fastened to the solenoid plunger. In the construction illustrated in FIGS. 2 and 3, the lower leg 33 of latch 31 defines an aperture 35 for receiving the upper end of an elongate push-pull cable 37. To prevent disassembly of the cable 37 from the latch, the upper terminus of the cable is formed with a suitable stop or hook 39. Spaced from the upper end of the cable and secured thereto, as by a set screw 41, is a collar 43. A compression spring 45 is interposed between the collar 43 and the lower leg 33 for a purpose to be explained hereinafter.

The push-pull cable 37 is guided in a conventional elongate sheath 47, the upper end of which is attached to the storage unit face panel 27 by a flanged clip 49 and screws 51. The lower end of the sheath is fastened to a wall 16 of carriage 17 by a second clip 53 and screws 55. The mounting versatility of the push-pull cable makes the locking mechanism of the present invention easily adaptable to all styles of shelving or face panels.

The lower end of the cable 37 is retained in the lock bar 57. For that purpose, the cable may be bent, as at 59, and the lock bar may be manufactured with a suitable slot and aperture 61 to receive the bent cable end. To allow vertical reciprocal motion, as viewed in FIGS. 2 and 3, of the lock bar while preventing other motions, the lock bar is guided loosely in guide blocks 63, 65, 67, and 69, which are suitably fastened to the carriage 17 by nuts and bolts 71. In the assembly illustrated in FIGS. 2 and 3, the lock bar reciprocates in the same direction and to the same extent as latch 31.

To lock the mobile storage unit in place along the tracks 13, the latch bar 57 engages the rack 73 which is firmly attached to a track by screws 75. In the preferred embodiment, the rack is fabricated with a plurality of teeth 77. Each tooth is formed with a horizontal flat tip 79 intermediate a vertical surface 81 and a sloping surface 83. The lower portion 86 of the lock bar is constructed to register with the spaces 85 between the teeth 77. Thus, the lock bar lower end 86 has a vertical surface 87 and a sloping surface 89 which correspond to the tooth vertical and sloping-surfaces 81 and 83, respectively.

To prevent accidental start up of the electric motor 88 when the storage units are locked, the locking mechanism of the present invention may include a safety device 90, FIGS. 3 and 4. In the illustrated embodiment, the safety device includes a microswitch 92 having a spring loaded lever 97. The free end of the lever 97 is in contact with the latch 31. When the latch is moved downwardly by the key 21, the microswitch is actuated, in conjunction with control 99, to break one or more motor circuits 101, FIG. 4. Thus, when locked in place, the mobile storage units are both mechanically and elecrically prevented from moving.

Before describing the operation of the locking mechanism of the present invention, it will be assumed that the fixed and mobile storage units 3, 5, 7, and 9 are initially located as shown in FIG. 1. All the mobile units may be moved to the left, as shown in FIG. 1, so that the aisles 91 are closed. The locking mechanism of the present invention will then retain all the storage units in the closed location. For that purpose, the locking mechanism may be actuated to the locked mode by key 21 prior to moving the storage unit 9 from the location shown in FIG. 1. Actuating the key causes the latch 31 to move downwardly with respect to FIGS. 2 and 3, thereby pushing spring 45 against collar 43. In turn, collar 43 induces motion to the cable 37 to cause the lock bar 57 to lower to the locked position, as shown by the lock bar solid lines in FIGS. 2 and 3. When the storage units are moved to the left with respect to FIGS. 1 and 3, the sloping surface 89 of the lock bar in storage unit 9 strikes the first rack tooth sloping surface 83. As a result, the lock bar is forced upwardly against spring 45 so that the stop 39 acquires the position indicated by phantom line 95 in FIG. 2. As the storage unit continues movement to the left, the lock bar passes onto the tip 79 of the first rack tooth and ultimately past the tooth to a space 85. The spring 45 urges the cable and lock bar downwardly into the space 85. The resilient ratcheting effect of the lock bar over the rack teeth continues without damage to the components until all of the aisles 91 are closed. At that point, further leftward movement is not possible. At the same time, the storage unit 9 is prevented from moving to the right, because of the locking action between the vertical surfaces 87 and 81. Thus, the mobile storage units 5, 7, and 9 are automatically locked in place along the tracks 13.

As an alternate method of operation, the locking mechanism 19 may be actuated after the mobile storage units 5, 7, and 9 are moved to their closed locations. In that case, turning the key 21 may immediately cause the lock bar lower end 86 to enter a space 85, thus completing the locking operation. It is possible, however, that the lock bar lower end may strike the tip 79 of a tooth 77. Because of the spring 45 in combination with the latch leg 33 and collar 43, the key may be completely turned to operate the latch 31, and the lock bar and cable stop will remain stationary, thus maintaining the position shown by phantom lines 93 and 95 without damage to any of the components A slight movement of the storage unit 9 to the right will automatically enable the lock bar lower end to enter a space 85, thereby allowing the spring 45 to force the lock bar into locking engagement with the rack. To accommodate different closed positions of the mobile storage units, several teeth are provided on the rack. Different closed locations occur because, for example, of stored material protruding beyond the shelves and into the aisle 91.

It will be recognized that the optional key actuated safety device 90 is absent for operation as above described. If the safety device 90 is included in the locking mechanism, the mobile storage units must be positioned to the desired locked location before the locking mechanism is actuated.

Thus, it is apparent that there has been provided in accordance with the invention, a lock for mobile storage apparatus that fully satisfies the objects, aims, and advantages set forth above. While the invention has been described in conjunction with specific embodiments thereof, it is evident that many alternatives, modifications, and variation will be apparent to those skilled in the art in light of the foregoing description. Accordingly, it is intended to embrace all such alternatives, modifications, and variations, and variations as fall within the spirit and broad scope of the appended claims.

I claim:

1. In combination with a mobile storage system having at least one wheeled mobile storage unit with a face panel and being translatable along a set of tracks, apparatus for selectively locking and unlocking the mobile storage unit at a predetermined location along the tracks comprising:

(a) rack means fastened to a track at the predetermined location of the mobile storage unit;

(b) lock actuating means mounted on the mobile storage unit face panel for selecting a locked or unlocked mode;

(c) a latch retained in the actuating means for reciprocable actuation thereby;

(d) guide block means attached to the mobile storage unit for defining a vertical passage;

(e) a lock bar mounted for vertical reciprocation within the guide block means and adapted to engage the rack means to prevent movement of the mobile storage unit;

(f) cable means for being pulled in a first direction by the latch to positively pull the lock bar out of engagement with the rack means and for being pushed in a second direction to push the lock bar into engagement with the rack means an abutment on said cable means and secured to said cable means; and (g) a compression spring arranged around the cable means and having one spring end engaged with said latch and the other spring end engaged with said abutment between the reciprocable latch and said abutment for resiliently pushing the cable means in the second direction to thereby push the lock bar into engagement with the rack means, so that selective actuation of the lock actuating means to the locked mode reciprocates the latch and compresses the spring to resiliently bias the cable means and lock bar into engagement with the rack means and selecting the lock actuating means to the unlocked mode reciprocates the latch to positively pull the cable means and lock bar out of engagement with the rack means.

2. The combination of claim 1 wherein the mobile storage system includes at least one intermediate mobile storage unit and an end mobile storage unit, and wherein the apparatus for locking the mobile storage system is mounted to the end mobile storage unit.

3. The combination of claim 1 wherein each rack tooth is formed with a tip intermediate a substantially vertical surface and a sloping surface, and wherein the lock bar is formed with corresponding vertical and sloping surfaces, so that the lock bar vertically reciprocates to resiliently ratchet over the teeth to permit movement of the mobile storage unit in one direction and to engage the teeth to lock the mobile storage unit against movement in the opposite direction when the lock means is actuated to the lock mode.

4. The combination of claim 1 wherein:

(a) the latch defines an aperture therethrough;

(b) the cable means includes an elongate push-pull cable having a first end passing through the latch aperture and terminating in a stop larger than the aperture and a second end rigidly retained in the lock bar;

(c) a collar is secured to the push-pull cable; and (d) the compression spring is interposed between the collar and the latch, so that actuation of the lock actuating means to the lock mode reciprocates the latch to bear against the compression spring to resiliently push the collar of the push-pull cable.

* * * * *